US007314355B2

(12) United States Patent
Ishida

(10) Patent No.: US 7,314,355 B2
(45) Date of Patent: Jan. 1, 2008

(54) COMPRESSOR INCLUDING DEVIATED SEPARATION CHAMBER

(75) Inventor: Yuki Ishida, Isesaki (JP)

(73) Assignee: Sanden Corporation, Gunma (JP)

( * ) Notice: Subject to any disclaimer, the term of this patent is extended or adjusted under 35 U.S.C. 154(b) by 91 days.

(21) Appl. No.: 11/135,369

(22) Filed: May 24, 2005

(65) Prior Publication Data

US 2005/0265878 A1 Dec. 1, 2005

(30) Foreign Application Priority Data

May 27, 2004 (JP) ..... 2004/158172

(51) Int. Cl.
*F01C 1/02* (2006.01)
*F03C 2/00* (2006.01)
*F04C 2/00* (2006.01)

(52) U.S. Cl. ..... 418/55.1; 418/55.6; 418/97; 418/270; 418/DIG. 1; 55/394; 55/396; 55/423; 55/459.1; 55/467

(58) Field of Classification Search ..... 418/55.1–55.6, 418/57, 97, 270, DIG. 1; 55/423, 467, 459.1, 55/394, 396
See application file for complete search history.

(56) References Cited

U.S. PATENT DOCUMENTS 1,405,259 A 1/1922 Beach
1,854,692 A 4/1932 Cooper
3,317,123 A 5/1967 Funke
3,499,270 A 3/1970 Paugh
3,684,412 A 8/1972 Harlin et al.
3,850,009 A 11/1974 Villadsen
4,332,535 A 6/1982 Terauchi et al.
4,343,599 A 8/1982 Kousokabe
4,360,321 A 11/1982 Copp, Jr. et al.
4,470,778 A 9/1984 Mabe
4,496,293 A 1/1985 Nakamura et al.
4,547,138 A 10/1985 Mabe et al.
4,666,381 A 5/1987 Butterworth
4,781,550 A 11/1988 Morishita et al.
4,842,499 A 6/1989 Nishida et al.
4,846,640 A 7/1989 Nishida et al.
4,865,530 A 9/1989 Nishida et al.
4,892,469 A * 1/1990 McCullough et al. ..... 418/55.6
4,900,238 A 2/1990 Shigemi et al.

(Continued)

FOREIGN PATENT DOCUMENTS

DE 2822780 12/1978

(Continued)

OTHER PUBLICATIONS

Publication: The AQUINAS System, Science Horizons, Inc., dated Mar. 2004, Part No. IR 04-0002, Version 1.0.

*Primary Examiner*—Theresa Trieu
(74) *Attorney, Agent, or Firm*—Baker Botts L.L.P.

(57) ABSTRACT

A compressor is provided with an oil separator disposed in between a discharge chamber of a refrigerant and a discharge port connected to a circulating path for the refrigerant. The oil separator has a separating chamber into which the refrigerant flows from the discharge chamber, and a separating tube disposed in the separation chamber. A portion of the separation chamber, which extends from the separating tube in the downward direction, deviates from the axis of the separating tube and forms a deviating area.

10 Claims, 4 Drawing Sheets

U.S. PATENT DOCUMENTS

| | | | | |
|---|---|---|---|---|
| 4,932,845 | A | | 6/1990 | Kikuchi et al. |
| 4,936,756 | A | | 6/1990 | Shimizu et al. |
| 4,940,396 | A | | 7/1990 | Shimizu et al. |
| 4,958,991 | A | | 9/1990 | Kikuchi |
| 5,271,245 | A | | 12/1993 | Westermeyer |
| 5,421,708 | A | | 6/1995 | Utter et al. |
| 5,733,107 | A | | 3/1998 | Ikeda et al. |
| 5,800,133 | A | | 9/1998 | Ikeda et al. |
| 6,010,320 | A | | 1/2000 | Kwon |
| 6,017,205 | A | | 1/2000 | Weatherston et al. |
| 6,074,186 | A | | 6/2000 | Lifson et al. |
| 6,152,713 | A | * | 11/2000 | Hisanaga et al. ..... 418/55.6 |
| 6,227,831 | B1 | * | 5/2001 | Osima et al. ..... 418/DIG. 1 |
| 6,322,339 | B1 | | 11/2001 | Mitsunaga et al. |
| 6,454,538 | B1 | | 9/2002 | Witham et al. |
| 6,485,535 | B1 | | 11/2002 | Linnersten et al. |
| 6,511,530 | B2 | | 1/2003 | Iwanami et al. |
| 6,755,632 | B1 | | 6/2004 | Ito et al. |
| 7,101,160 | B2 | * | 9/2006 | Gennami et al. ..... 418/55.6 |
| 2005/0129536 | A1 | | 6/2005 | Ohtake |
| 2005/0129556 | A1 | | 6/2005 | Ito |
| 2005/0226756 | A1 | | 10/2005 | Ito |
| 2006/0065012 | A1 | | 3/2006 | Kudo |

FOREIGN PATENT DOCUMENTS

| | | | | |
|---|---|---|---|---|
| EP | WO8505403 | | | 12/1985 |
| EP | WO8600369 | | | 1/1986 |
| EP | 0317900 | | | 5/1989 |
| JP | S54-047110 | A | | 4/1979 |
| JP | S57-143187 | A | | 9/1982 |
| JP | 61205386 | | | 9/1986 |
| JP | 6316190 | | | 1/1988 |
| JP | S63-106393 | A | | 5/1988 |
| JP | 07151083 | A | * | 6/1995 |
| JP | H07-151083 | A | | 6/1995 |
| JP | H11-082352 | A | | 3/1999 |
| JP | 2000-170681 | A | | 6/2000 |
| JP | 2001295767 | | | 10/2001 |
| JP | 2003129975 | A | * | 5/2003 |

* cited by examiner

COMPRESSOR INCLUDING DEVIATED SEPARATION CHAMBER

This nonprovisional application claims priority under 35 U.S.C. §119(a) on Patent Application No. 2004-158172 filed in Japan on May 27, 2004, the entire contents of which are hereby incorporated by reference.

BACKGROUND OF THE INVENTION

1. Field of the Invention

The present invention relates to a compressor, and more specifically to a compressor used in a refrigeration circuit of an air-conditioning system for a vehicle.

2. Description of the Related Art

The compressor of a refrigeration circuit of this type includes a housing in which a suction chamber and a discharge chamber are defined, and a compression unit accommodated in the housing. The compression unit repeatedly performs a series of processes, which include the suction of a refrigerant as a working fluid, the compression of the sucked refrigerant, and the discharge of the compressed refrigerant into the discharge chamber. The high-pressure refrigerant in the discharge chamber is delivered from the discharge port of the housing toward a condenser of the refrigeration circuit. The delivered refrigerant flows through the refrigeration circuit and is returned into the suction chamber through the suction port of the housing. In short, the refrigerant circulates through the refrigeration circuit.

The refrigerant contains mist-like lubricating oil. The lubricating oil contained in the refrigerant not only lubricates sliding surfaces, bearings, and the like, in the compressor but also is useful for sealing compression chambers defined in the compression unit.

However, when a great deal of lubricating oil is contained in the refrigerant flowing through the refrigeration circuit except for the compressor, the lubricating oil deteriorates the refrigeration performance of the refrigeration circuit, namely the air-conditioning system. Therefore, the compressor disclosed in Unexamined Japanese Patent Publication No. 2001-295767 is provided with an oil separator, which is disposed in a discharge chamber.

The oil separator includes a separating chamber located adjacently to the discharge chamber. The separating chamber communicates with the discharge chamber through jet holes and has a separating tube that is concentrically arranged therewithin. The refrigerant in the discharge chamber flows through the jet holes into the separating chamber and swirls around the separating tube. Such a swirling movement of the refrigerant applies a centrifugal force to the lubricating oil contained in the refrigerant, thereby separating a portion of the lubricating oil from the refrigerant. After running into the inner surface of the separating chamber, the separated lubricating oil flows downward along the inner surface of the separating chamber, and is collected from the separating chamber to be reserved in an oil chamber. The refrigerant that has undergone the action of centrifugal separation is guided from the separating chamber through the separating tube to the discharge port.

The lubricating oil in the oil chamber is sprayed into the suction chamber through an orifice path and is mixed again into the refrigerant in the suction chamber.

When the oil separator is built in the compressor, the refrigerant flowing through the refrigeration circuit except for the compressor contains a small amount of lubricating oil. The oil separator then prevents a deterioration in refrigeration performance of the air-conditioning system, which is caused by the lubricating oil.

As is already apparent from the above explanation, the oil separator uses centrifugal separation to separate the lubricating oil from the refrigerant. For an effective separation of the lubricating oil, therefore, the refrigerant needs to be powerfully swirled around the separating tube at high speed.

However, when the compressor is operated in a low speed range, that is, when a delivered amount of the refrigerant from the compressor is small, the amount and flow rate of the refrigerant that flows from the discharge chamber into the separating chamber are both lessened. As a result, it is impossible to produce a high-speed and powerful swirling flow of the refrigerant around the separating tube.

Accordingly, in a case that the compressor is in the aforementioned operational condition, the oil separator cannot satisfactorily separate the lubricating oil from the refrigerant. This causes not only a deterioration in refrigeration performance of the air-conditioning system but also a reduction in stores of the lubricating oil in the oil chamber, which makes the liquid level of the lubricating oil lower than the orifice path.

In such a case, the orifice path is not filled with the lubricating oil, so that the refrigerant in the discharge chamber short-cuttingly flows through the separating chamber, the oil chamber and the orifice path into the suction chamber. This considerably decreases the compression efficiency of the compressor, that is, refrigeration performance of the air-conditioning system.

SUMMARY OF THE INVENTION

An object of the present invention is to provide a compressor capable of satisfactorily performing separation of lubricating oil from a working fluid even when the compressor is operated in a low speed range.

To achieve the above object, the compressor of the present invention comprises: a housing including a suction chamber and a discharge chamber each defined therewithin, a suction port for supplying a working fluid that contains lubricating oil into the suction chamber, and a discharge port communicated with the discharge chamber; a compression unit disposed in the housing, for performing a series of processes including suction of the working fluid from the suction chamber, compression of a sucked working fluid, and discharge of a compressed working fluid into the discharge chamber; and an oil separator for separating a portion of the lubricating oil from the working fluid in the discharge chamber, and then delivering the working fluid toward the discharge port while collecting separated lubricating oil, the oil separator including an oil chamber defined in the housing so that the oil chamber is positioned below the discharge chamber, for collecting the separated lubricating oil, a dividing wall disposed in the discharge chamber, for forming a separating chamber partitioned off from the discharge chamber so that the working fluid flows from the discharge chamber into the separating chamber, the separation chamber having an upper area, a lower area extending from the upper area in a downward direction and having an inner surface so as to provide a bottom with respect to the upper area, and at least one outlet for allowing the lower area to communicate with the oil chamber, a separation tube disposed in the upper area of the separating chamber, for causing the working fluid flowed into the separating chamber to swirl around the separating tube, and then to guide the working fluid toward the discharge port, and a return path for returning the lubricating oil in the oil chamber back to the suction chamber.

According to the above-described compressor, the working fluid discharged from the compression unit to the discharge chamber flows into the upper area of the separating chamber in the oil separator and swirls around the separating tube. Such a swirling flow of the working fluid moves downward along the separating tube and proceeds from the upper area into the lower area of the separating chamber. The swirling flow of the working fluid within the upper area exerts centrifugal force on the lubricating oil contained in the working fluid, thereby separating a portion of the lubricating oil from the working fluid.

Since the inner surface of the lower area provides the bottom with respect the upper area, the inner surface restricts dispersion of the swirling flow of the working fluid when the swirling flow proceeds from the upper area to the lower area. Accordingly, the swirling flow of the working fluid is kept even after proceeding to the lower area, and further separates a portion of the lubricating oil from the working fluid.

As described above, when the working fluid passes through the oil separator, the working fluid is subjected to primary and secondary processes for separating the lubricating oil. Therefore, even when the compressor is operated in a low speed range, the oil separator separates a great deal of lubricating oil from the working fluid and collects the separated lubricating oil in the oil chamber. As a result, the liquid level of the lubricating oil in the oil chamber is constantly kept above the return path of the lubricating oil, and the working fluid in the discharge chamber does not short-cuttingly flow through the separating chamber, the oil chamber and the return path into the suction chamber.

When the compressor of the present invention is used for a refrigeration circuit of an air-conditioning system of a vehicle, the compressor compresses the refrigerant serving as a working fluid. The refrigerant passing through the oil separator is subjected to the primary and secondary processes for separating the lubricating oil. Consequently, even when the compressor is operated in a low speed range, the refrigerant flowing through the refrigeration circuit except for the compressor contains a small content of the lubricating oil. This allows the air-conditioning system to fully provide refrigeration performance thereof.

Specifically, the compression unit is preferably a scroll unit having a movable scroll and a fixed scroll. The discharge chamber is formed in between the fixed scroll and an end wall of the housing.

A first area of the separation chamber is a straight area extending in a vertical direction. The lower area is a deviating area that deviates from an axis of the straight area and extends downward.

In this case, it is desired that the straight area and the deviating area each form the shape of a cylinder.

The deviating area is curved into a circular arc or helix. In addition, the deviating area may be bent to have the shape of letter L right under the straight area. In either case, the inner surface of the deviating area provides the bottom with respect to the straight area.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
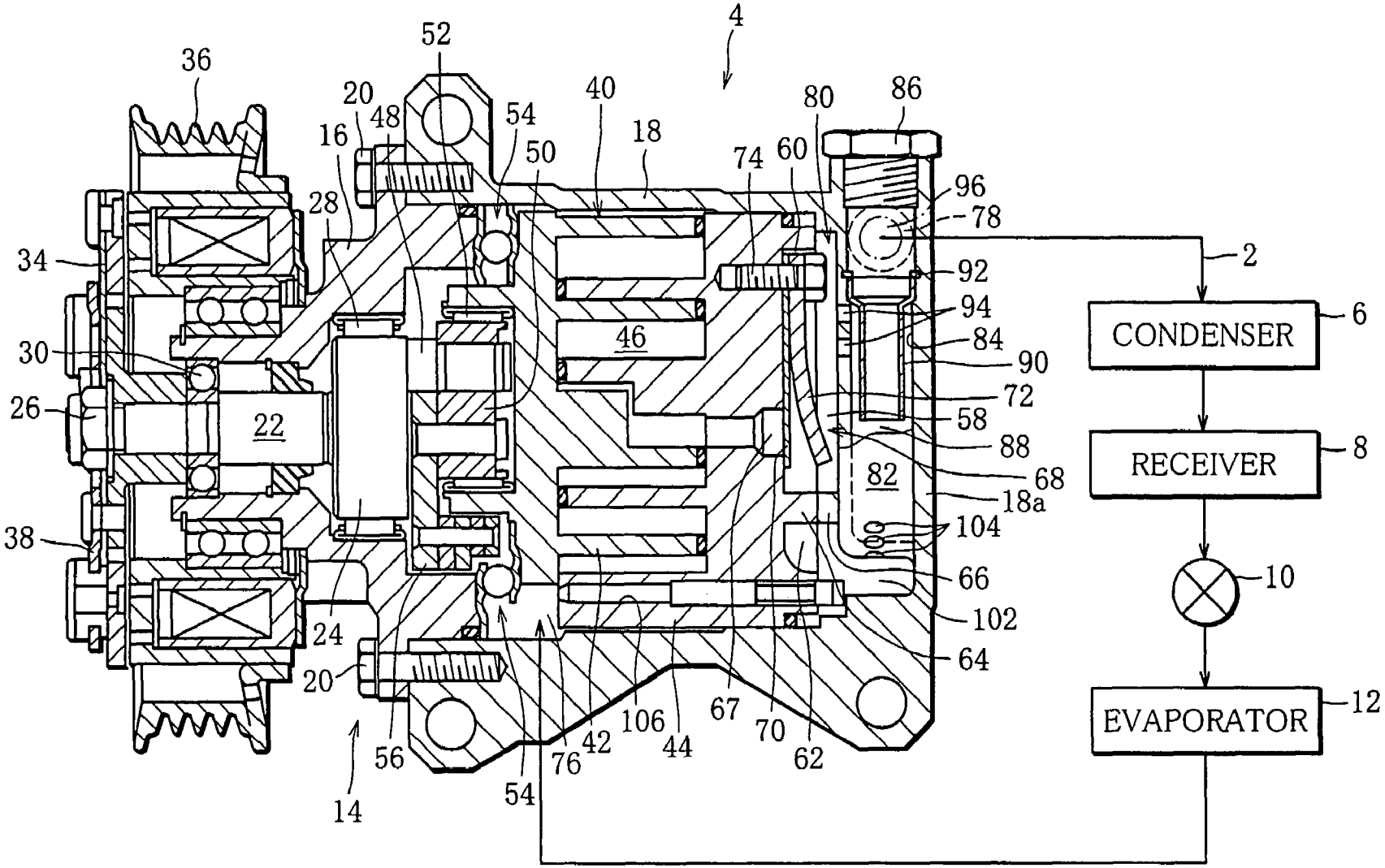
FIG. 1 is a longitudinal sectional view of a scroll compressor of one embodiment.

An air-conditioning system for a vehicle is provided with a refrigeration circuit as shown in FIG. 1. The refrigeration circuit includes a circulating path 2 for a refrigerant (working fluid). Disposed in the circulating path 2 in order are a compressor 4, a condenser 6, a receiver 8, an expansion valve 10 and an evaporator 12.

The compressor 4 compresses the refrigerant. A compressed high-pressure refrigerant is then delivered from the compressor 4 to the circulating path 2 and circulates through the refrigeration circuit. The refrigerant contains mist-like lubricating oil. The lubricating oil contained in the refrigerant not only lubricates bearings and various sliding surfaces in the compressor but also is useful for sealing after-mentioned compression chambers.

The compressor 4 of FIG. 1 is shown as a scroll compressor. The compressor 4 is provided with a cylindrical housing 14, which has a front casing 16 and a rear casing 18. The casings 16 and 18 have flanges in contact with each other, and these flanges are joined together with a plurality of connecting bolts 20.

A drive shaft 22 is disposed in the front casing 16. The drive shaft 22 has a large-diameter end portion 24 located on the rear casing 18 side and a small-diameter shaft portion 26 extending from the large-diameter end portion 24. The small-diameter shaft portion 26 protrudes from the front casing 16 in an outward direction. The large-diameter end portion 24 is rotatably supported by the front casing 16 through a needle bearing 28. The small-diameter shaft portion 26 is rotatably supported by the front casing 16 through a ball bearing 30.

Furthermore, the small-diameter shaft portion 26 is surrounded by a lip seal 32 which is located in between the ball bearing 30 and the large-diameter end portion 24 and airtightly seals the front casing 16.

A drive pulley 36 is connected to a projecting end of the small-diameter shaft portion 26 through an electromagnetic clutch 34. The drive pulley 36 is rotatably supported by an outer circumferential surface of the front casing 16 through a bearing 38. An engine of the vehicle is provided with an output pulley, which is connected to the drive pulley 36 through a drive belt. The power of the engine is transmitted to the drive pulley 36 and rotates the drive pulley 36. The engine, the output pulley, and the drive belt are not shown in FIG. 1.

When the electromagnetic clutch 34 is ON, the rotation of the drive pulley 36 is transmitted through the electromagnetic clutch 34 to the drive shaft 22. The drive shaft 22 is rotated with the drive pulley 36.

Accommodated in the rear casing 18 is a compression unit, namely a scroll unit 40. The scroll unit 40 includes a movable scroll 42 and a fixed scroll 44. The scrolls 42 and 44 each have a spiral wall. These spiral walls are so arranged as to be engaged with each other, and form compression chambers 46 therebetween. When the movable scroll 42 revolves with respect to the fixed scroll 44 without rotating on its own axis, one of the compression chambers 46 is moved from an outer circumference of the fixed scroll 44 toward the center of the fixed scroll 44. In this moving process, a capacity of the compression chamber 46 is reduced.

In order to bring the movable scroll 42 into the revolving movement thereof, the large-diameter end portion 24 of the drive shaft 22 is coupled to the movable scroll 42 through a crank pin 48, an eccentric bush 50, and a needle bearing 52. There is disposed a ball coupling 54 between the movable scroll 42 and the front casing 16. The ball coupling 54 inhibits the rotation of the movable scroll 42 on its own axis. A revolution radius of the movable scroll 42 is determined by distance between axes of the drive shaft 22 and the crank pin 48.

Fixed to the eccentric bush 50 is a counter weight 56 with respect to the movable scroll 42. The counter weight 56 is useful for stabilizing the revolving movement of the movable scroll 42.

The fixed scroll 44 is fixed in the rear casing 18 with a plurality of mounting bolts (not shown). There is space secured in between the fixed scroll 44 and an end wall 18*a* of the rear casing 18.

More specifically, the fixed scroll 44 has recesses 60 and 62 in a back surface thereof. The recesses 60 and 62 are vertically separated from each other by a partition wall 64. The end wall 18*a* of the rear casing 18 also has a partition wall 66 which protrudes toward the fixed scroll 44 to be butted against the partition wall 64. The partition walls 64 and 66, in cooperation with each other, divide the above-mentioned space into two chambers. One is a discharge chamber 58 including the recess 60, and the other is an oil chamber 102 including the recess 62.

The fixed scroll 44 has a discharge hole 67 at the center thereof. The discharge hole 67 opens in the discharge chamber 58, or in the recess 60 of the fixed scroll 44. When one of the compression chambers 46 reaches the center of the fixed scroll 44, the compression chamber 46 is connected to the discharge hole 67. Disposed in the recess 60 is a discharge valve 68, which opens and closes the discharge hole 67. The discharge valve 68 includes a valve lead 70 and a stopper plate 72 that regulates the opening of the valve lead 70. The valve lead 70 and the stopper plate 72 are mounted to the fixed scroll 44 with a mounting screw 74.

A suction chamber 76 is secured in between an outer circumferential wall of the rear casing 18 and the scroll unit 40. The suction chamber 76 is connected to the circulating path 2, or evaporator 12, through a suction port 77 (see FIG. 2). The suction port 77 is formed in an outer circumferential surface of the rear casing 18.

Figure 2:
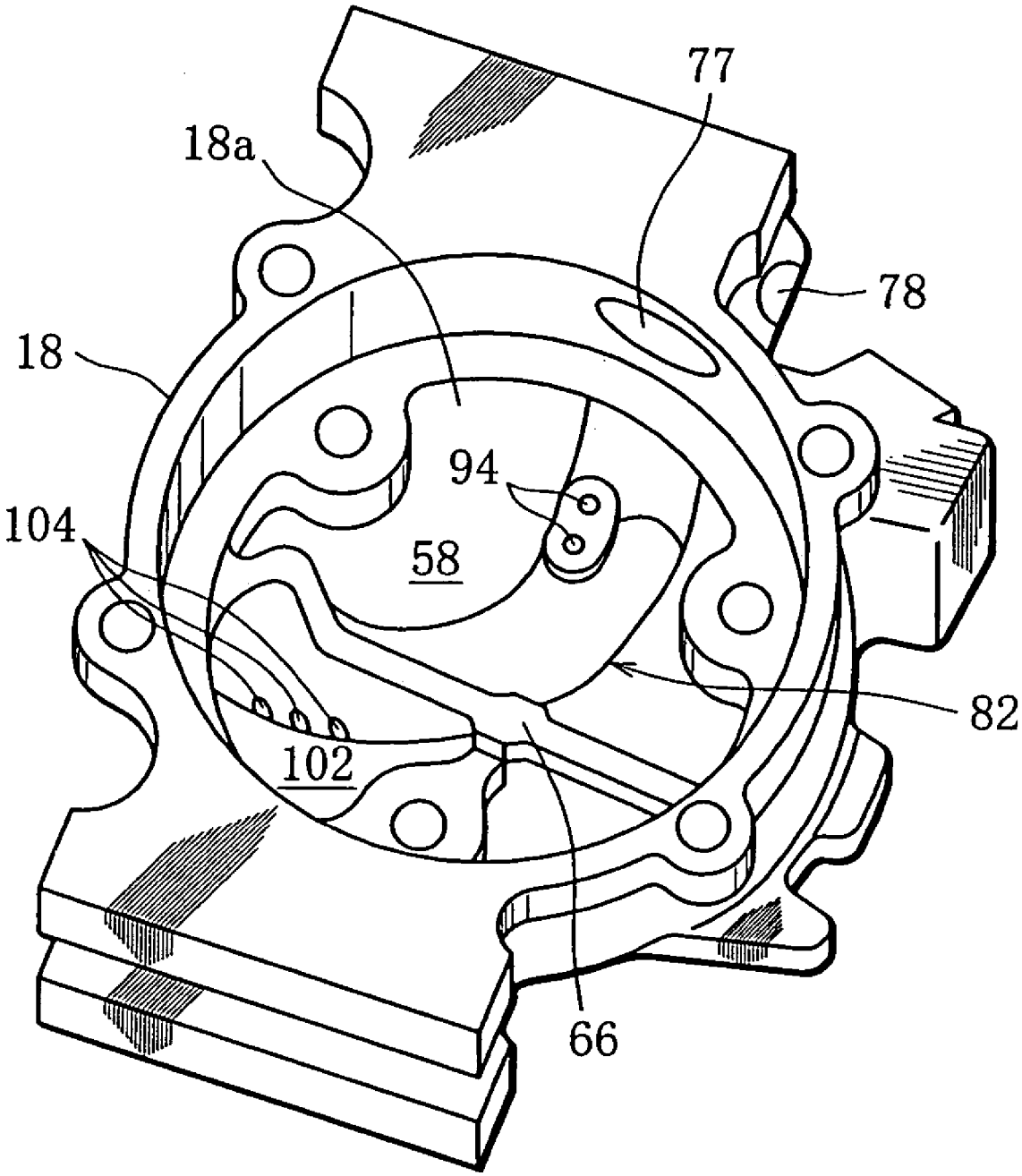
FIG. 2 is a perspective view showing the inside of a rear casing of FIG. 1.

Formed in the end wall 18*a* of the rear casing 18 is a discharge port 78 (see FIG. 2). The discharge port 78 is connected to the condenser 6 through the circulating path 2 and is also connected to the discharge chamber 58 via the oil separator 80.

The oil separator 80 will be described below in detail.

As is clear from FIG. 2, the end wall 18*a* of the rear casing 18 has an bulged portion 82 in an inner surface thereof. The bulged portion 82 is formed integrally with the rear casing 18 and protrudes toward the inside of the rear casing 18. The bulged portion 82 is extended from a top portion of the outer circumferential wall of the rear casing 18 to intersect the partition wall 66 in the vertical direction. In the oil chamber 102, a lower end of the bulged portion 82 is connected to a lower portion of the outer circumferential wall in the rear casing 18.

Figure 3:
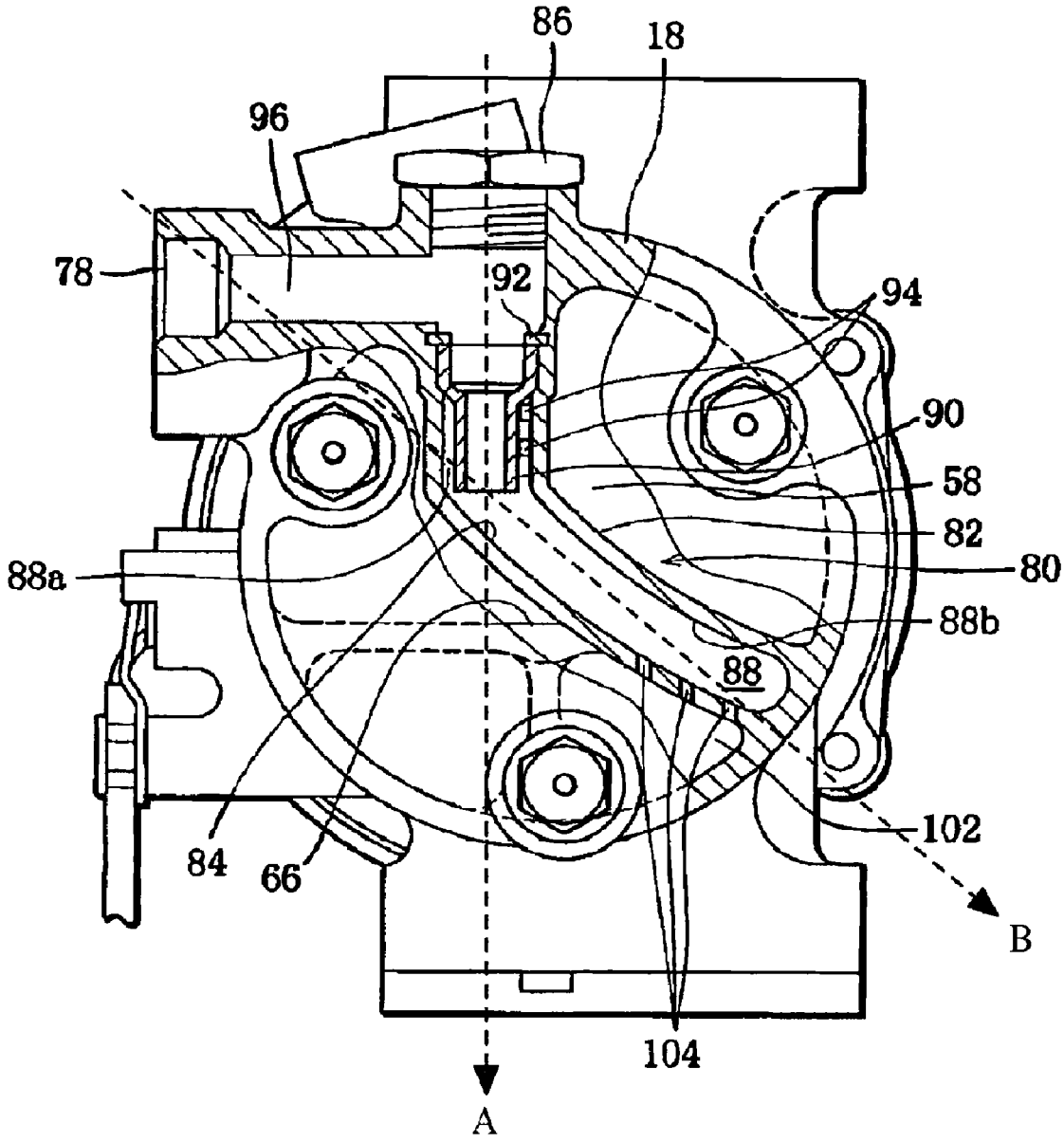
FIG. 3 is a side view showing an end wall of the rear casing of FIG. 1, partially broken away.

As illustrated in FIG. 3, the bulged portion 82 is a hollow dividing wall, and a bore 84 having a circular shape in section is defined in the bulged portion 82. The bore 84 extends along a longitudinal direction of the bulged portion 82. An upper end of the bore 84 opens in the outer circumferential wall of the rear casing 18, and this opening end is closed with a plug 86. Furthermore, a connection hole 96 is formed in the rear casing 18. The connection hole 96 extends from an upper portion of the bore 84 toward the discharge port 78, thereby connecting the bore 84 and the discharge port 78 to each other.

Part of the bore 84 is formed as a separating chamber 88, which is located lower than the connection hole 96. Disposed in an upper portion of the separating chamber 88 is a separating tube 90. The separating tube 90 has a large-diameter portion in an upper end thereof. The large-diameter portion of the tube 90 is pressed into the bore 84, and the separating tube 90 is thus fixed within the separation chamber 88. A snap ring 92 is disposed in the upper end of the separating tube 90. The snap ring 92 prevents the separating tube 90 from coming out of the separating chamber 88.

An annular space 88*a* is secured in between a lower end portion of the separating tube 90 and an inner circumferential surface of the separating chamber 88. In other words, the separating tube 90 is located concentrically in the separating chamber 88. In the bulged portion 82, there is formed for example a pair of jet holes 94. The jet holes 94 are arranged one above the other at a distance so that the annular space 88*a* communicates with the discharge chamber 58. The jet holes 94 each have an axis tangent to an outer circumferential surface of the separating tube 90.

As is obvious from FIGS. 1 and 3, although the annular space 88*a* is formed in between a straight area of the bore 84, which extends along a first axis (A), and the separating tube 90, a portion of the bore 84, which is located lower than the annular space 88*a*, is formed as a curved deviating area 88*b*. The deviating area 88*b* extends so as to deviate from the axis of the separating tube 90 according as the deviating area 88*b* goes away from the straight area of the bore 84, namely the separating tube 90. The deviating area 88*b* may include a portion extending in a downward direction along a second axis (B) at an acute angle from the first axis(A) of the straight area of bore 84, which may include the separating tube 90. The deviating area 88*b* may be defined, in part, by an inner side surface so as to provide a bottom with respect to the separating tube 90. Thus, as shown in FIG. 3, for example, a separation chamber 88 may have an upper area on the first axis (A) and a lower area extending along the second axis (B) at an acute angle from the first axis from the upper area in a downward direction and havina an inner side surface so as to provide a bottom with respect to the upper area. In this embodiment, the deviating area 88*b* is formed into a circular arc that extends in the opposite direction from the discharge port 78.

The deviating area 88*b* has at least one outlet 104 in a lower portion thereof. In this embodiment, three outlets 104 are provided. The outlets 104 open in the oil chamber 102 at a distance from one another in a vertical direction, thereby making the separating chamber 88 and the oil chamber 102 communicate with each other.

As illustrated in FIG. 1, an orifice path 106 is formed in the fixed scroll 44. The orifice path 106 allows a bottom of the oil chamber 102 and the suction chamber 76 to communicate with each other. More specifically, the orifice path 106 includes a passage penetrating the fixed scroll 44 and a rod member inserted into the passage. The rod member has an oil strainer and a minute through-hole.

According to the above-described compressor, when the drive shaft 22 is rotated, the movable scroll 42 revolves in a state prevented from rotating on its own axis. Such a revolving movement of the movable scroll 42 causes the refrigerant to be sucked from the suction chamber 76 into one compression chamber 46, and compresses the sucked refrigerant in the compression chamber 46. Subsequently, when the compression chamber 46 reaches the discharge hole 67, and refrigerant pressure in the compression chamber 46 overcomes closing pressure of the discharge valve 68, the discharge valve 68 is opened. At this time, a high-pressure refrigerant is discharged from the compression chamber 46 through the discharge hole 67 to the discharge chamber 58.

Since the refrigerant contains lubricating oil as described, the lubricating oil in the refrigerant which passes through the compressor 4 not only lubricates the bearings 28 and 52 and sliding surfaces in the front casing 16 but also is useful for sealing the compression chambers 46.

The high-pressure refrigerant in the discharge chamber 58 flows through the jet holes 94 into the separating chamber 88 of the oil separator 80, or into the annular space 88*a*. The refrigerant flowed therein moves downward while swirling around the separating tube 90 in the annular space 88*a*. In this process, the lubricating oil in the refrigerant undergoes the action of centrifugal separation so that part of the lubricating oil is primarily separated from the refrigerant. The separated lubricating oil runs into an inner circumferential surface of the separating chamber 88 so as to be received by the inner circumferential surface.

The refrigerant subjected to the primary separation process proceeds from the annular space 88*a* into the deviating area 88*b* in a state where the swirling movement of the refrigerant is kept. The refrigerant then flows along an inner circumferential surface of the deviating area 88*b*. Therefore, the refrigerant undergoes the action of centrifugal separation also in the deviating area 88*b*. Part of the lubricating oil is further separated from the refrigerant, and the separated lubricating oil is received on the inner circumferential surface of the deviating area 88*b*.

Detailed explanations about the aforementioned process will be provided below. The deviating area 88*b* does not extend on the axis of the annular space 88*a*, or of the separating tube 90, and deviates from the axis of the separating tube 90. Accordingly, part of the inner circumferential surface of the deviating area 88*b* provides a bottom with respect to the annular space 88*a*. The bottom functions as a guide surface that restricts dispersion of the swirling flow of the refrigerant and guides the swirling flow after passing a lower end of the separating tube 90. Consequently, even when the swirling flow of the refrigerant proceeds into the deviating area 88*b*, swirling energy of the refrigerant is sufficiently kept, and swirling velocity of the refrigerant is not drastically decreased. As a consequence, the refrigerant swirls along the inner circumferential surface of the deviating area 88*b* and is secondarily subjected to a process for separating the lubricating oil due to a centrifugal force.

Thereafter, the refrigerant subjected to the primary and secondary processes for separating the lubricating oil is guided through the separating tube 90 and the connection hole 96 to the discharge port 78, and is delivered from the discharge port 78 through the circulating path 2 toward the condenser 6.

Meanwhile, the lubricating oil separated from the refrigerant flows downward along the inner surface of the deviating area 88*b*, and is collected in the oil chamber 102 through the outlets 104. Since the oil chamber 102 is always communicated with the separation chamber 88, the pressure in the oil chamber 102 is sufficiently higher than that in the suction chamber 76. For this reason, the lubricating oil in the oil chamber 102 is returned to the suction chamber 76 through the orifice path 106 due to pressure difference between the oil chamber 102 and the suction chamber 76. In this returning process, the lubricating oil is introduced into the suction chamber 76 in a mist-like form, and is satisfactorily mixed into the refrigerant in the suction chamber 76. As a result, the refrigerant flowing through the front casing 16 and the scroll unit 40 contains a great deal of lubricating oil. Therefore, the lubrication and sealing required in the compressor 4 are sufficiently achieved by the lubricating oil in the refrigerant.

As described above, the refrigerant passing through the oil separator 80 is subjected to the primary and secondary processes for separating the lubricating oil. Therefore, even when the compressor is operated in a low speed range, and flow velocity of the refrigerant that flows from the discharge chamber 58 into the separating chamber 88, that is, swirling velocity of the refrigerant in the separating chamber 88, is low, it is possible not only to effectively separate the lubricating oil from the refrigerant but also to reserve a sufficient amount of lubricating oil in the oil chamber 102.

As a result, since the amount of lubricating oil in the refrigerant, which is delivered from the compressor 4 to the circulating path 2 is small, and a liquid level of the lubricating oil in the oil chamber 102 is kept above the orifice path 106, the air-conditioning system can fully provide refrigeration performance thereof. In addition, the discharge chamber 58 does not directly communicate with the suction chamber 76 through the separating chamber 88, the oil chamber 102, and the orifice path 106. Therefore, the refrigerant in the discharge chamber 58 does not short-cuttingly flow into the suction chamber 76, and compression efficiency of the compressor is not deteriorated.

The present invention is not limited to the above-described one embodiment, and various modifications can be made.

Figure 4:
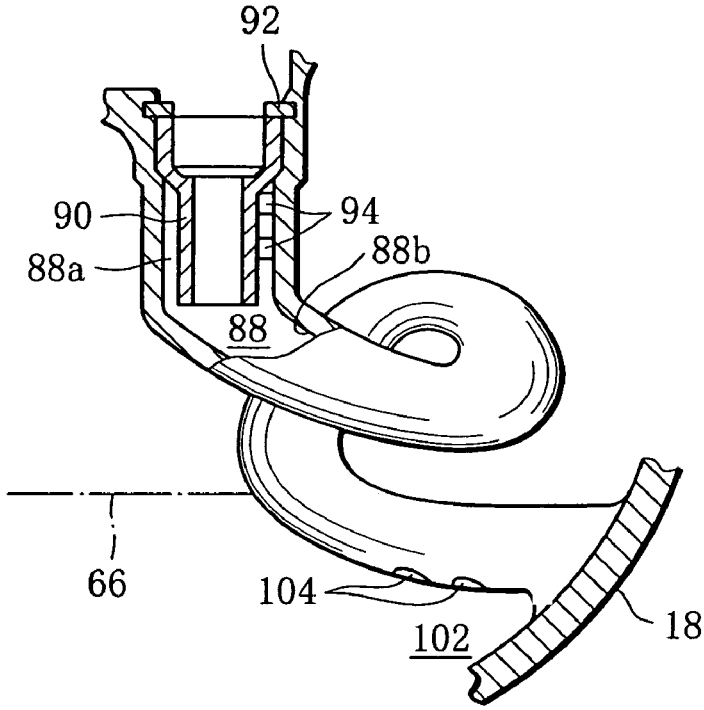
FIGS. 4 and 5 are views each showing a separation chamber of a modification example, respectively.
Figure 5:
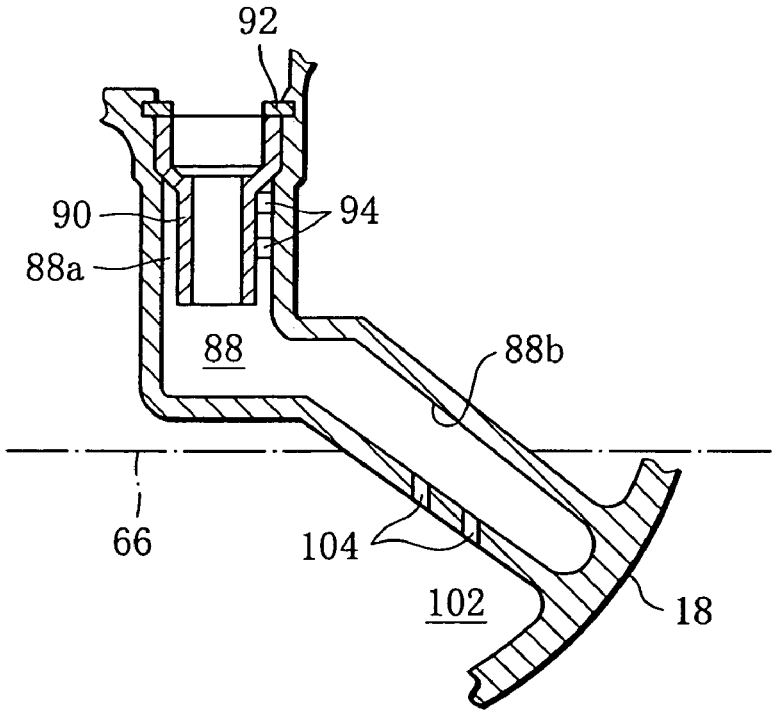

The deviating area 88*b* of the separating chamber 88 is not limited to a circular-arc shape, but may have any arbitrary shape on the condition that it does not extend on the axis of the separating tube 90. For example, as illustrated in FIG. 4, the deviating area 88*b* may have a helical shape. As illustrated in FIG. 5, the deviating area 88*b* may be bent into the letter L right under the annular space 88*a*. Moreover, the deviating area 88*b* may deviate toward the discharge port 78.

Lastly, it should be noted that the present invention is applicable not only to a scroll compressor but also to a reciprocating piston-type compressor as well.

What is claimed is:

1. A compressor comprising:

a housing including a suction chamber and a discharge chamber each defined therein, a suction port for supplying a working fluid that contains lubricating oil to the suction chamber, and a discharge port communicated with the discharge chamber;

a compression unit disposed in said housing, for performing a series of processes including suction of the working fluid from the suction chamber, compression of a sucked working fluid, and discharge of a compressed working fluid into the discharge chamber; and an oil separator for separating a portion of the lubricating oil from the working fluid in the discharge chamber and then delivering the working fluid toward the discharge port while collecting separated lubricating oil, said oil separator including an oil chamber defined in said housing so that the oil chamber is positioned below the discharge chamber, for collecting the separated lubricating oil, a dividing wall disposed in the discharge chamber, for forming a separating chamber partitioned off from the discharge chamber so that the working fluid flows from the discharge chamber into the separating chamber, the separating chamber having an upper area on a first axis, a lower area extending along a second axis at an acute angle from the first axis from the upper area in a downward direction and having an inner side surface so as to provide a bottom with respect to the upper area, and at least one outlet for allowing the lower area to communicate with the oil chamber, a separating tube disposed substantially on the first axis in the upper area of the separating chamber, for causing the working fluid flowed into the separating chamber to swirl around said separating tube, and then guiding the working fluid toward the discharge port, and a return path for returning the lubricating oil in the oil chamber back to the suction chamber.

2. The compressor according to claim 1, wherein: said compression unit includes a scroll unit having a movable scroll and a fixed scroll; and the discharge chamber is formed in between the fixed scroll and an end wall of said housing.

3. The compressor according to claim 2, wherein: the dividing wall includes an bulged portion integrally protruding from an inner surface of the end wall of said housing into the discharge chamber.

4. The compressor according to claim 3, wherein: the lower area of the separating chamber has a lower portion located in the oil chamber, and the lower portion is provided with-a plurality of outlets.

5. The compressor according to claim 4, wherein: the upper area is a straight area extending in a vertical direction, and the lower area is a deviating area that deviates from an axis of the upper area and extends downward.

6. The compressor according to claim 5, wherein: the straight area and the deviating area are each formed in the shape of a cylinder.

7. The compressor according to claim 6, wherein: the deviating area is curved into a circular arc.

8. The compressor according to claim 7, wherein: the deviating area extends in an opposite direction from the discharge port.

9. The compressor according to claim 6, wherein: the deviating area extends to form a helix.

10. The compressor according to claim 6, wherein: the deviating area is bent into the letter L right under the straight area.

* * * * *